United States Patent [19]

Boltrek et al.

[11] Patent Number: 4,589,539

[45] Date of Patent: May 20, 1986

[54] TRANSPORTATION APPARATUS HAVING A MOVING HANDRAIL

[75] Inventors: Henry Boltrek, Freeport, N.Y.; Edward F. Parvis, Roxbury, N.J.

[73] Assignee: Westinghouse Electric Corp., Pittsburgh, Pa.

[21] Appl. No.: 532,436

[22] Filed: Sep. 15, 1983

[51] Int. Cl.[4] ..... B66B 21/00; B66B 23/06

[52] U.S. Cl. ..... 198/331

[58] Field of Search ..... 198/336, 331, 335, 329, 198/330, 855, 835, 813

[56] References Cited

U.S. PATENT DOCUMENTS

| | | | |
|---|---|---|---|
| 994,879 | 6/1911 | Seeberger | 198/329 |
| 2,885,057 | 5/1959 | Hansen | 198/336 |
| 3,666,075 | 5/1972 | Iwata | 198/335 |
| 3,707,220 | 12/1972 | Boltrek et al. | 198/330 |
| 3,779,360 | 12/1973 | Taher et al. | 198/335 |
| 4,200,177 | 4/1980 | Sato et al. | 198/335 |
| 4,381,851 | 5/1983 | Kraft | 198/329 |

FOREIGN PATENT DOCUMENTS

| | | | |
|---|---|---|---|
| 1086930 | 10/1967 | United Kingdom | 198/330 |

*Primary Examiner*—Joseph E. Valenza
*Assistant Examiner*—Daniel R. Alexander
*Attorney, Agent, or Firm*—D. R. Lackey

[57] ABSTRACT

Transportation apparatus, such as a moving walk or an escalator, having a continuous handrail driven about a closed loop by a handrail drive. The closed loop includes a longitudinal axis, or axes, which divide a load run on which passengers may grasp the handrail, and a return run. The transportation apparatus includes a drive unit which, in addition to driving the transportation apparatus, also drives the handrail drive via a drive chain or belt. The chain or belt is automatically tensioned, notwithstanding wear thereof, or longitudinal positional adjustment of the apparatus drive unit towards either end of the apparatus, by mounting the handrail drive unit such that it is free to move longitudinally, in either direction of the handrail, restrained only by the drive chain or belt.

7 Claims, 12 Drawing Figures

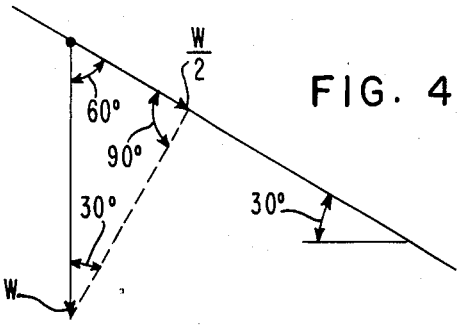
FIG. 4
FIG. 5
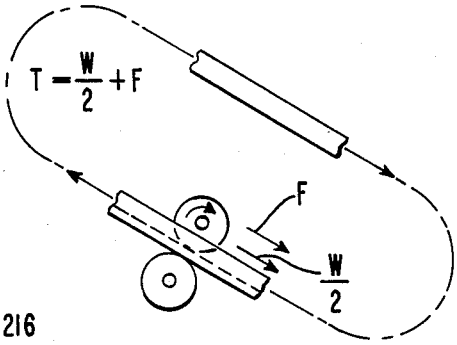
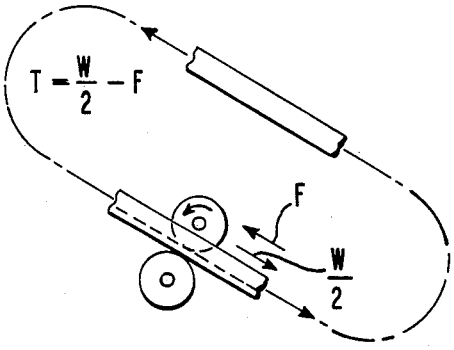
FIG. 6
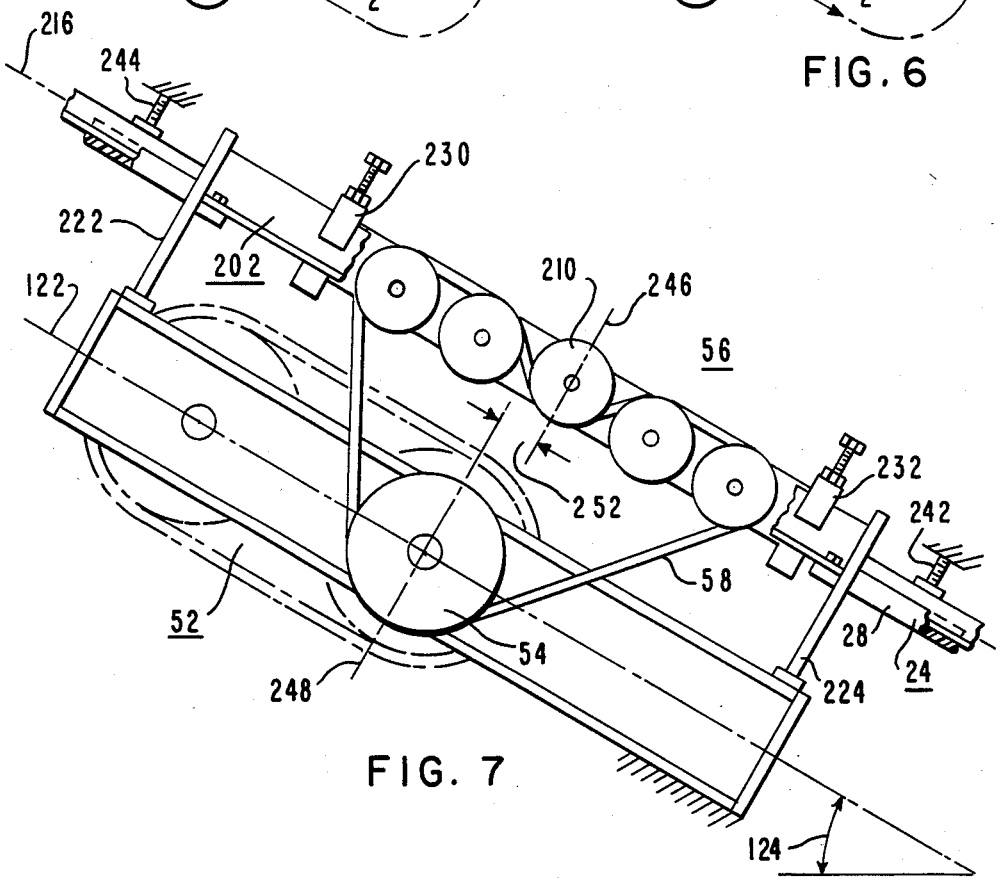
FIG. 7

TRANSPORTATION APPARATUS HAVING A MOVING HANDRAIL

BACKGROUND OF THE INVENTION

1. Field of the Invention:

The invention relates in general to transportation apparatus, and more specifically to transportation apparatus which includes a moving handrail, such as moving walks and escalators.

2. Description of the Prior Art:

Transportation apparatus for transporting passengers between spaced landings, such as moving walks and escalators, include a continuous, flexible handrail on each side of the conveyor portion of the apparatus. Each handrail is driven about a closed loop by one or more handrail drive units, which are operated by, and thus in synchronism with, the conveyor drive unit, or units. The closed handrail loop includes an upper run to be grasped by conveyor passengers, and a lower or return run, and curved end portions which connect the upper and lower runs.

In the modular type of construction set forth in U.S. Pat. No. 3,707,220, which is assigned to the same assignee as the present application, in which one or more drive units are mounted in the support truss of the transportation apparatus, each conveyor drive unit may drive a handrail drive unit via a drive chain or belt. A conveyor drive unit is positionally adjusted and fixed for proper engagement with the conveyor, and then the handrail drive unit is positionally adjusted and fixed for proper tension in the drive chain or belt. Subsequent readjustment of the position of the conveyor drive unit, requires readjustment of the handrail drive unit. Wear and/or stretch of the drive chain or drive belt requires readjustment of the handrail drive unit.

SUMMARY OF THE INVENTION

Briefly, the present invention is a new and improved escalator or movable walk of the type which has one or more drive units disposed in a support truss, which drive unit, or units, engage both the load bearing and return runs of the conveyor portion of the apparatus. At least one of the drive units powers a handrail drive via a drive chain or drive belt. Instead of adjusting and then fixing the handrail unit to provide belt or chain tension in a desired range, the handrail drive unit is mounted for guided longitudinal movement, i.e., for movement in either direction on a line through the longitudinal axis of the handrail portion being driven. The position of the handrail drive is restrained only by the drive chain or drive belt. In a horizontal application, such as a moving walk, the handrail drive will move to a limit defined by the chain or belt loop, in response to the force required to drive the handrail about its closed loop. In an inclined application, such as an escalator, several embodiments are set forth to properly tension the drive chain or drive belt, including offsetting the force in the drive chain due to the weight of the drive unit, selecting the weight of the drive unit such that the force component due thereto always exceeds the force required to drive the handrail, and selecting the weight of the drive unit such that the weight-induced force component in the chain or belt is less than the force required to drive the handrail.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 4 is a force diagram which illustrates the tensioning force component in the handrail drive chain or belt of an escalator due to the weight of the handrail drive unit;

FIG. 5 illustrates the tensioning forces in the handrail drive belt or chain of an escalator due to the weight of the handrail drive unit, and the force required to drive the handrail about its closed loop, when the return portion of the handrail is driven up the incline;

FIG. 6 illustrates the tensioning forces in the handrail drive belt or chain of an escalator due to the weight of the handrail drive unit, and the force required to drive the handrail about its closed loop, when the return portion of the handrail is driven down the incline:

FIG. 7 illustrates how the handrail drive unit shown in FIG. 2 will adjust its position down the incline to develop the desired drive chain tension in certain embodiments of the invention;

DESCRIPTION OF PREFERRED EMBODIMENTS

Figure 1:
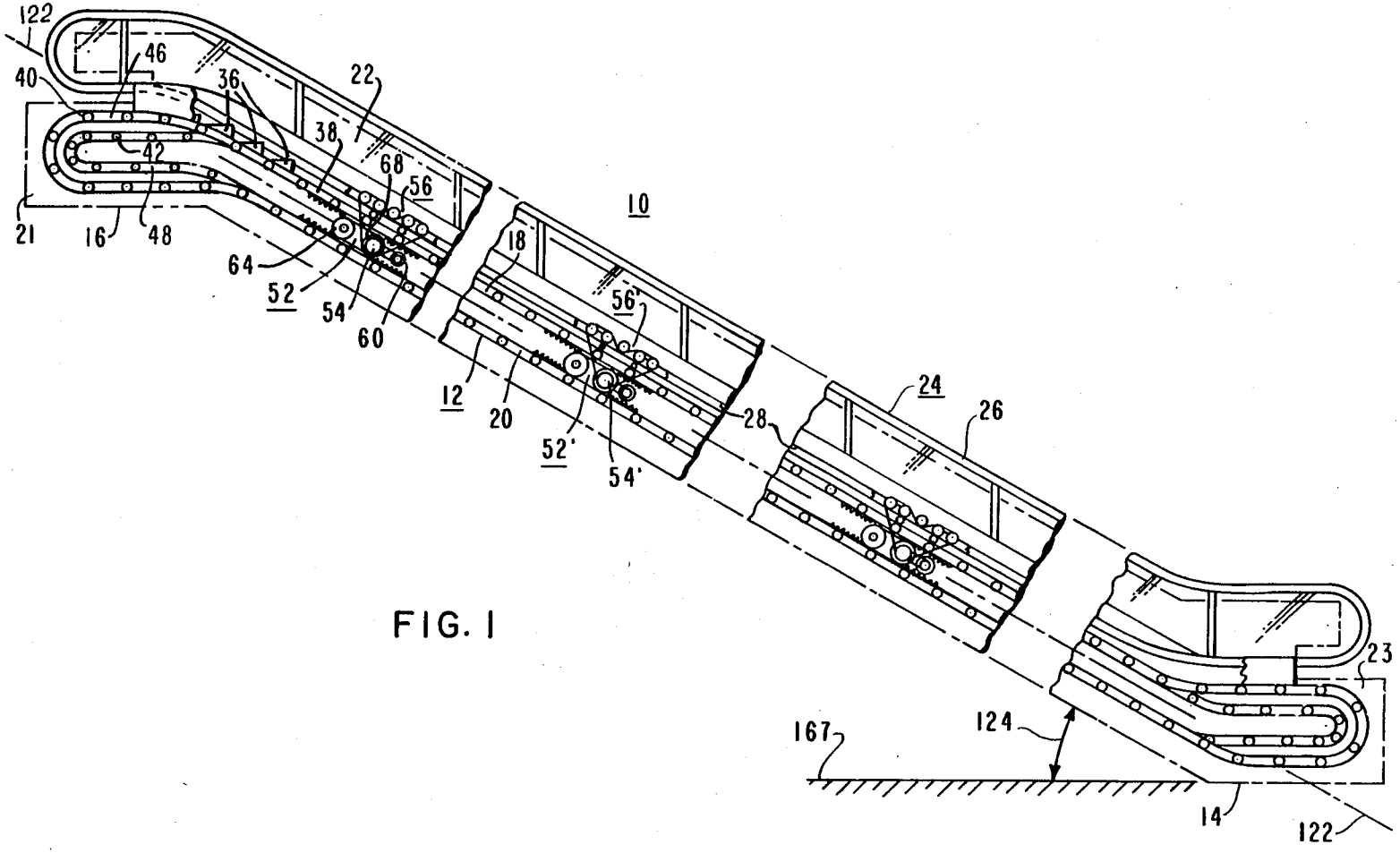
FIG. 1 is an elevational view of an escalator which may be constructed according to the teachings of the invention.

Referring now to the drawings, and to FIG. 1 in particular, there is shown transportation apparatus 10 which may utilize the teachings of the invention. While the invention is equally applicable to moving walkways, for purposes of example it will be described relative to an escalator 10. The escalator 10 is inclined from a horizontal plane 167 by a predetermined angle 124, such as 30°. Escalator 10 employs a conveyor portion 12 for transporting passengers between a first or a lower landing 14 and a second or upper landing 16. Conveyor 12 is of the endless type, having an upper load bearing run 18 on which passengers stand while being transported between the landings, a lower run 20, and upper and lower turnarounds 21 and 23, respectively, which interconnect the load bearing and return runs. While the invention may be utilized with any type of movable stairway which utilizes rigid spacing of the belt supporting guide wheels via toothed step links, its use is particularly advantageous with the modular passenger conveyor construction disclosed in U.S. Pat. No. 3,707,220, and with the substantially continuous stationary handrail guide arrangement disclosed in U.S. Pat. No. 3,712,447. Suitable handrail drive units which may be modified according to the teachings of the invention are shown in U.S. Pat. Nos. 3,414,109 and 3,779,360. These patents, all of which are assigned to the same assignee as the present application, are hereby incorporated into the present application by reference.

Conveyor 12 has first and second sides, each of which is formed of rigid, pivotally interconnected toothed step links 38. The two sides of the conveyor are interconnected by step axles 39, shown in FIG. 11, with a step 36 being connected to each step axle. The conveyor 12 is supported by guide and support rollers or wheels 40 which cooperate with guide tracks 46. The steps 36, in addition to being supported by the step axles 39, are also supported and guided by trailer wheels or rollers 42 which cooperate with trailer guide tracks 48 to guide and support the steps in the endless loop. One or more modular drive units, such as modular drive units 52 and 52', engage the toothed links 38, to drive the conveyor in either of its directions. In other words, conveyor 12 may be driven such that the steps 36 move up the incline, or it may be driven in the opposite direction, to cause the steps 36 to move down the incline, on the load bearing run of the escalator.

A balustrade 22 is disposed above the conveyor 12, on each side thereof, for guiding a continuous, flexible handrail 24. The balustrade guides the handrail 24 as it moves about a closed loop which includes an upper run 26 during which a surface of the handrail 24 may be grasped by passengers as they are transported along the conveyor 12, and it also includes a lower or return run 28.

Figure 3:
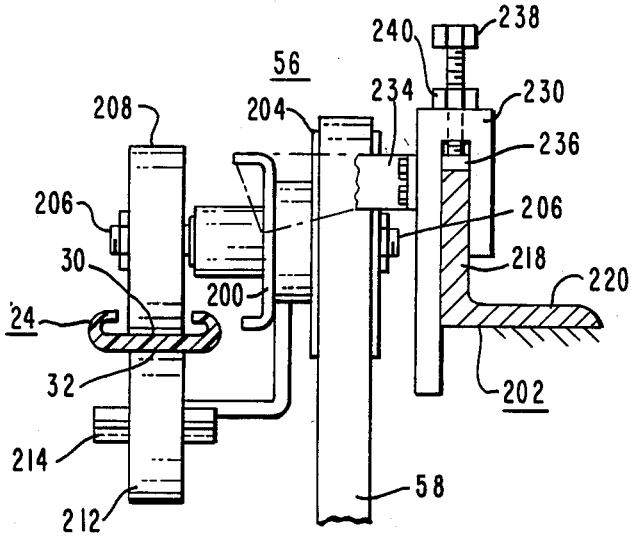
FIG. 3 is a view of the handrail drive unit shown in FIG. 2, taken between and in the direction of arrows III—III.

The handrail 24, shown in section in FIG. 3, has a substantially c-shaped cross section, having first and second substantially flat, parallel major opposed surfaces 30 and 32, respectively, which define the major body portion of the handrail. Major side 30 is the inner side of the handrail, which rides on the support structure of the balustrade 22, and major side 32 is the outer side which is available for support by passengers during the upper run 26 of the handrail 24.

Figure 2:
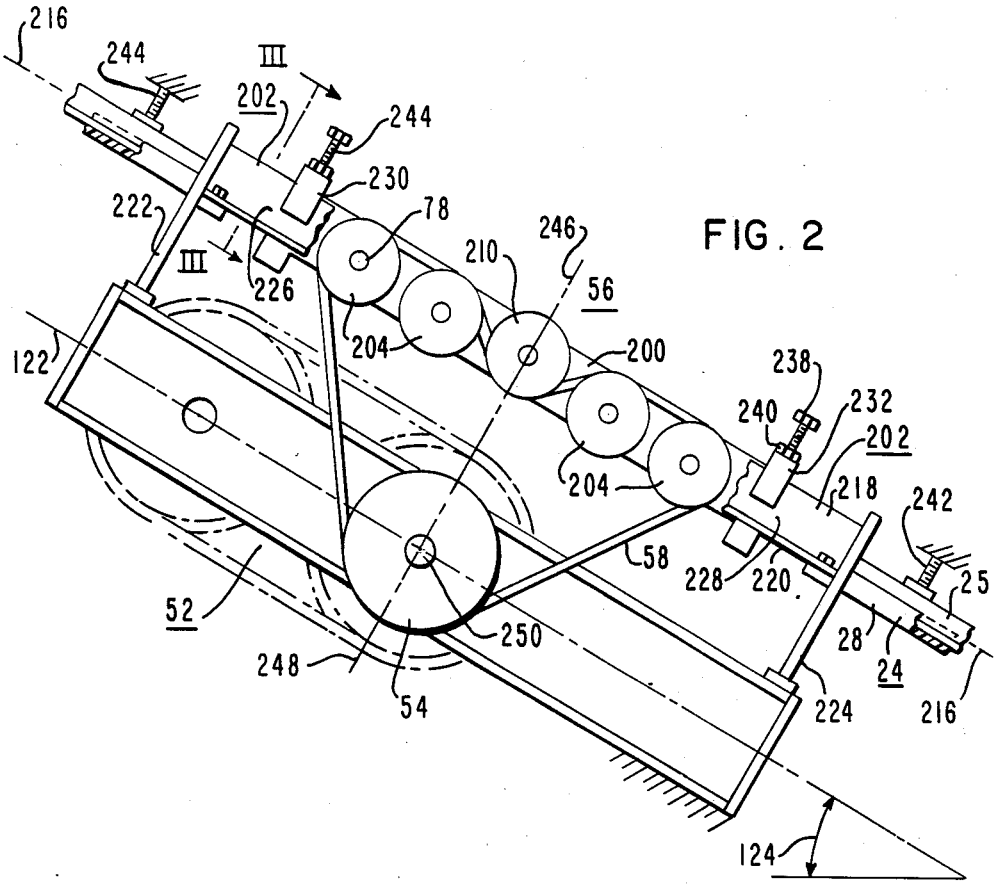
FIG. 2 is an elevational view of a handrail drive unit constructed according to the teachings of the invention, which may be used for the handrail drive unit shown in FIG. 1.
Figure 12:
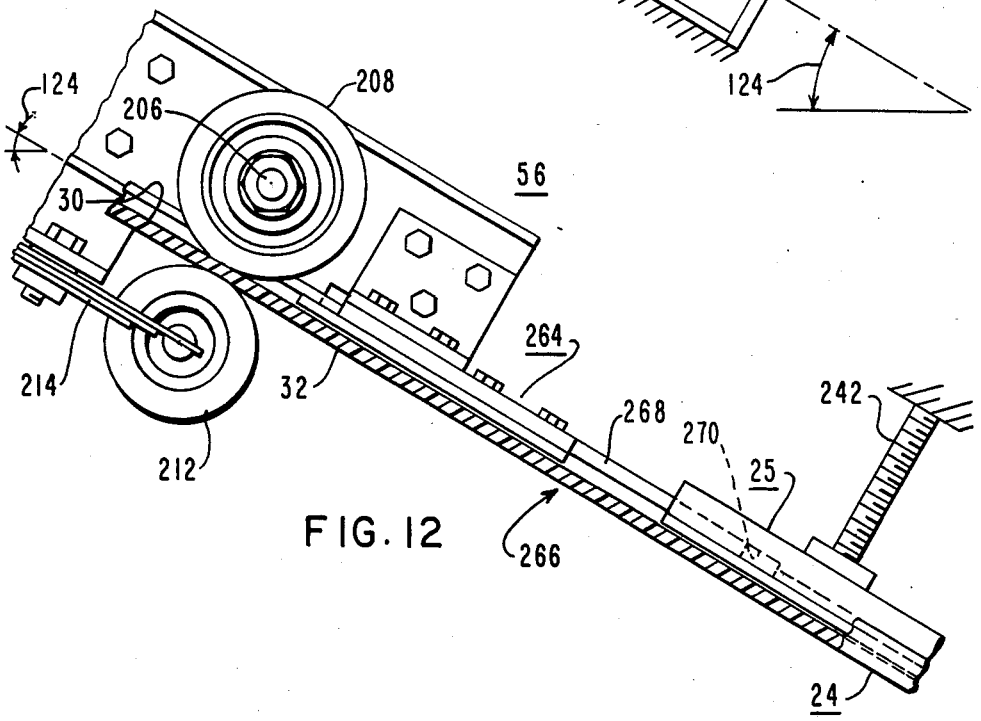
FIG. 12 is an elevational view, partially in section, of an arrangement which continues the handrail guide function, between the movable handrail drive unit and the stationary handrail guide structures adjacent to its ends.

The balustrade 22 may be transparent as indicated, or opaque, as desired. The handrail 24 is guided around the balustrade by suitable guide means disposed thereon, such as a T-shaped guide which is located within the cross section of the handrail 24. The guide means on both the upper and lower runs of the handrail, as well as the turnarounds, such as guide means 25 shown in FIGS. 2 and 12, is preferably continuous, at least to the extent that any gaps are bridged by the handrail 24 without lateral movement of the handrail, permitting the handrail to be pushed as well as pulled by the handrail drive means 56 around the guide loop. This "continuous" guide concept of handrail operation is disclosed in incorporated U.S. Pat. No. 3,712,447. As hereinbefore stated, conveyor 12, and thus the steps 36, are driven by one or more drive units, such as drive units 52 and 52'. Since each drive unit is similar in construction, only drive unit 52 will be described. Drive unit 52 includes a drive motor 60 which drives a pair of spaced drive sprockets, such as a drive sprocket 64, via a gear reducer (not shown), a pair of spaced idler sprockets, such as sprocket 68, and a drive chain 84 for engaging the toothed links 38. The modular drive unit 52 includes a handrail drive pulley 54 on each side of the conveyor 12. Each pulley 54 drives a handrail drive unit 56 disposed on its side of the conveyor 12. The handrail drive unit 56 on each side of the conveyor 12 may be of similar construction, and any additional handrail drive units provided when additional modular drive units are utilized to drive the conveyor 12 may also be similar.

Handrail drive unit 56 is shown in greater detail in FIG. 2, which is an elevation thereof of the driven side. FIG. 3 is an end view of the drive unit 56, taken between and in the direction of arrows III—III of FIG. 2. Handrail drive unit 56 includes a sturdy metallic channel member 200 to which the components of the drive unit 56 are fixed, and the channel member 200 is mounted on an elongated slide bar member 202, as will be hereinafter explained in detail. For purposes of example, handrail drive unit 56 is illustrated as being constructed according to the drive unit of incorporated U.S. Pat. No. 3,779,360. It includes a plurality of auxiliary drive pulleys or sprocket wheels 204 which are driven by the handrail drive pulley 54 and a drive belt or sprocket chain 58. The handrail drive pulley 54 may be connected to the driven sprocket 64, or to the idler sprocket 68. U.S. Pat. No. 3,677,388, which is assigned to the same assignee as the present application, shows the former, and co-pending application Ser. No. 532,427, filed Sept. 15, 1983 entitled "Transportation Apparatus", which is assigned to the same assignee as the present application, shows the latter. Each auxiliary handrail drive pulley 204 may be toothed, and the sprocket chain or belt may have cooperative teeth formed thereon of any suitable form. The sprocket chain may be a timing belt formed of metal, or of an elastomeric material having a metallic embedment which makes the belt substantially inextensible. The auxiliary handrail drive pulleys 204 are each secured to one side of channel 200 via individual bearing and shaft assemblies, such as shaft 206 shown in FIG. 3. Pulley 204 is keyed to shaft 206. Shaft 206 extends through channel member 200 and a traction or drive roller 208 is keyed thereto, with the traction or drive roller 208 being on the opposite side of the channel member 200 from the pulley 204. Thus, when auxiliary drive pulley 204 is rotated by the drive belt 58, a traction roller 208 on the same shaft is also driven.

Traction roller 208 is disposed such that a portion of its periphery or rim engages the inner surface 30 of the handrail 24. Traction roller 208 may be constructed of a rigid material, such as steel coated with a high friction material on its periphery, or it may have a metallic hub provided with an elastomeric or rubber tire, as desired.

A plurality of pairs of drive pulleys 204 and traction rollers 208 are provided at spaced intervals along channel 200, with the peripheries of the plurality of traction rollers 208 all falling on a line which coincides with the return run 28 of the handrail 24. After the drive belt 58 passes over the upper surfaces of a predetermined number of adjacent auxiliary drive pulleys 204, it may pass under a take-up pulley 210 before passing over the upper surfaces of the next group of auxiliary drive pulleys.

A plurality of pressure rollers 212 are provided, which are urged or biased against the surface 32 of handrail 24, and towards a traction roller 208. The biasing means may include a leaf spring assembly 214. The traction and pressure rollers are provided in cooperative pairs, with each pair providing a driving point for squeezing and propelling the handrail 24 about its closed guide loop. Each pressure roller may be formed of a rigid material, such as stainless steel, or it may be constructed with a metallic hub which is provided with an elastomeric tire.

As hereinbefore stated, the complete handrail drive unit 56 is mounted for longitudinal slidable movement, with the "longitudinal" referring to the direction of the longitudinal axis 216 of the return run 28 of the handrail 24. Axis 216 is parallel with a longitudinal axis 122 disposed through the inclined portion of the modular drive unit 52, which axis forms the angle 124 With the horizontal plane 167. The elongated slide bar 202, upon which the handrail drive unit 56 is mounted for slidable movement, may be fixed to the modular drive unit 52, as shown in FIG. 2. Alternatively, it may be fixed to members of the support truss 120 of the escalator 10, as shown in the FIG. 11 embodiment of the invention. Slide bar 202 may be of any suitable construction, such as being in the form of an elongated right angle member having first and second leg portions 218 and 220. Leg portion 218 has its surfaces which will be subjected to sliding contact finished and lubricated to provide a low friction sliding surface, and leg 220 may be used as a mounting flange. For example, first and second upstanding support members 222 and 224, respectively, may be fastened to the modular drive unit 52, and the mounting flange 220 may be fastened to these support members. Suitable adjustment means (not shown) may be used to select and fix the desired location of slide bar 202 relative to the support members 222 and 224.

The first and second longitudinal ends 226 and 228, respectively, of the handrail drive assembly 56 are connected to slide hanger members 230 and 232, respectively. For example, each slide hanger member may be connected to a bracket 234, which in turn is connected to channel member 200. A bearing shoe 236, bolt 238 and lock nut 240 may be arranged to adjustably select, and then fix, the position of the handrail drive assembly 56 relative to the slide bar 202, and thus relative to the longitudinal axis 216 of the handrail 24 it is to drive. Bolt 238 extends through a threaded opening in hanger 230, and its extreme end is rotatably fixed to the bearing shoe 236. After bolt 238 has been turned to provide the desired position, lock nut 240 secures the position. The handrail guide 25 is also adjustable, such as by spaced support hangers 242 and 244 at opposite ends of the drive unit 56.

The handrail drive unit 56 is held in position on the slide bar only by the drive chain 58. Once the handrail drive unit 56 is properly oriented, there is no need to adjust its position up or down the incline. When the modular drive unit 52 is positionally adjusted along its longitudinal axis 122, the handrail drive unit 56 will automatically adjust itself on the slide bar 202, to the new position of drive unit 52.

FIG. 2 shows the handrail drive 56 with the shortest possible loop of drive chain 58. With this "shortest loop" condition, the midpoint of the drive rollers, indicated by the line 246, is disposed through the rotational axis of the take-up roller 210. Line 246 is perpendicular to the longitudinal axis 122, and it coincides with a line 248 which is perpendicular to the longitudinal axis 122, and which passes through the rotational axis 250 of pulley 54. With the present invention, it is not necessary to try to achieve, or to maintain this "shortest loop" configuration. Also, wear of the drive chain or belt 58, which increases the size of the loop, is automatically accommodated for. No readjustments of the handrail drive 56 are required due to wear of the drive chain.

FIG. 4 is a force diagram which illustrates the effect of the weight of the handrail drive unit 56 on the tension in the drive chain or belt 58 for an escalator having an incline of 30°. The weight of the handrail drive unit 56 is indicated by the force W exerted vertically downward in FIG. 4. The force component along the incline, exerted by the handrail drive unit 56 on the chain 58, by virtue of the slide mounting arrangement, is equal to W sine 30, or W/2. Additional tension is developed in the drive chain 58 which is equal to the force required to drive the handrail 24 about its closed guided loop. If the modular drive unit 52 is set for downward travel, i.e., the escalator steps 36 move down the incline on the passenger bearing run, the handrail 24 will also move down the incline on its upper run 26. Thus, the handrail drive unit 56 will drive the return run 28 of the handrail 24 up the incline. The force F required to drive the handrail 24 up the return run incline is directed down the incline, as indicated by the diagrammatic representation of the handrail loop in FIG. 5. In this situation, the tension T in the drive chain will be equal to $W/2+F$.

If the rotational direction of the modular or main drive unit 52 is reversed, to cause the load bearing run of the escalator 10 to carry passengers up the incline, the handrail drive unit 56 will also be reversed, and the return run 28 of the handrail 24 will be driven down the incline in order to cause the upper run 26 of the handrail 24 to move up the incline, along with the steps 36. In this instance, the direction of the force F required to drive the handrail 24 about its closed, guided loop reverses, as shown in FIG. 6, and the tension T in the drive chain will thus be equal to $W/2-F$.

Since it is essential to maintain a certain amount of tension in the drive chain, the expression $W/2-F$ must not be equal to, or be close to, zero. In other words, the weight, or effective weight, W of the handrail drive means is selected such that the summation of forces in the handrail drive belt or chain 58, due to the weight W and to the drive force F, produces a net tensioning force in the desired range, for each handrail driving direction. A range of 50 to 100 pounds with intermittent peaks of 200 pounds or less would result in excellent belt life.

A first embodiment of the invention includes measuring the force F required to drive the handrail 24 about its closed guided loop, such as by using the arrangement disclosed in the hereinbefore mentioned co-pending application Ser. No. 532,427. This arrangement involves disconnecting the handrail drive pulley 54 from the sprocket it is normally attached to, and turning the pulley 54 with a torque wrench. The handrail drive unit 56 is then designed such that its weight divided by 2 exceeds the force F. In this embodiment, the handrail drive unit 56 will tension the drive chain 58 by moving to the lowest position on the slide bar 202 which the chain loop will allow, regardless of the direction of movement of the handrail. As shown in FIG. 7, the handrail drive unit will move down the incline by a dimension 252 between the line 246 which passes through the rotational axis of the take-up pulley 210, and the line 248 which passes through the rotational axis of the main handrail drive pulley 54. The handrail drive unit 56 will roll along the handrail 24, down the incline, until reaching the position allowed by the length of the drive chain loop, and it will tension the drive chain 58 by an amount equal to W/2+F when the return side 28 of the handrail is being driven up, and W/2−F when the return side of the handrail is being driven down. Thus, if the weight W of the handrail drive unit 56 is 150 pounds, for example, and the force F required to drive the handrail about its closed loop is 50 pounds, the chain tension will be 150/2+50, or 125 pounds in the one instance, and 150/2−50, or 25 pounds in the other.

Figure 8:
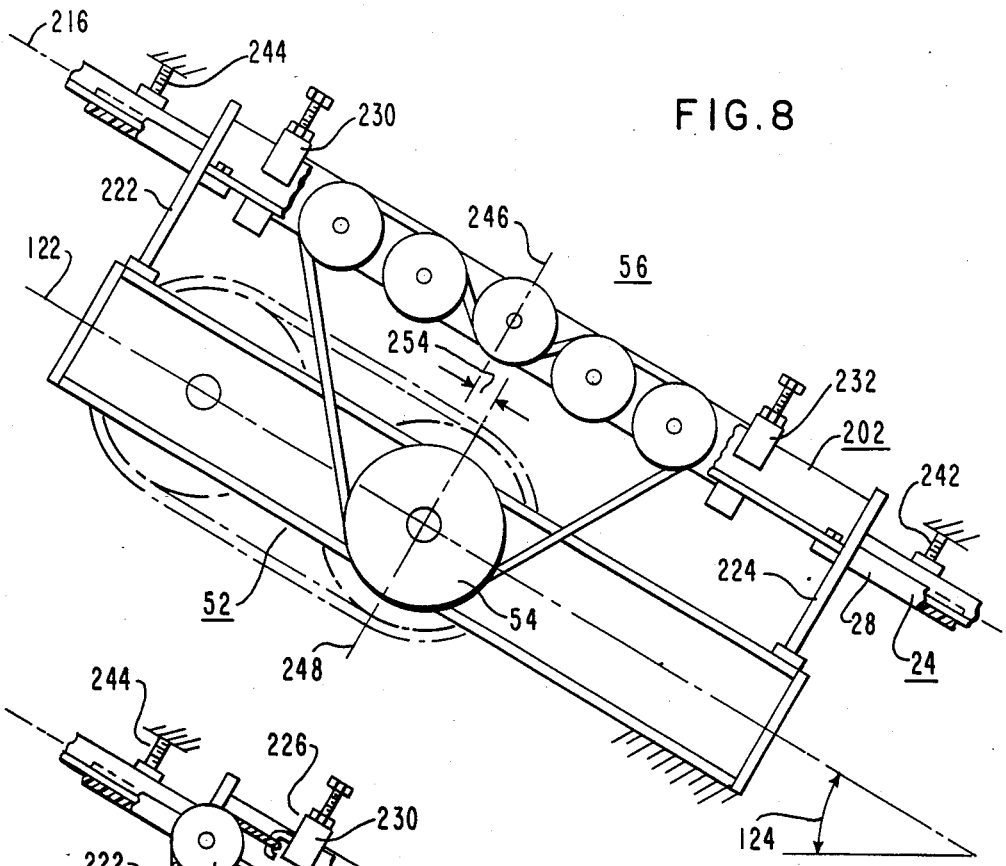
FIG. 8 illustrates how the handrail drive unit shown in FIG. 2 will adjust its position up the incline, to develop the desired drive chain tension in other embodiments of the invention.

In another embodiment of the invention, the force F is determined as before, and the handrail drive unit 56 is designed such that its weight W divided by 2 is less than the force F. In this embodiment, the handrail drive unit 56 will tension the drive chain 58 by moving to the lowest position on the slide bar 202 the drive chain loop will allow, as shown in FIG. 7, when the handrail 24 is being driven up the return run 28. Thus, the chain tension T will be equal to W/2+F. If F is equal to 75 pounds, for example, the drive may be designed to weigh 100 pounds, for example, and the tension T will be equal to 100/2+75, or 125 pounds. The handrail drive unit 56 will tension the drive chain 58 by moving to the highest position on the slide bar 202 the drive chain loop will allow, as shown in FIG. 8, when the handrail 24 is being driven down the return side 28. When the main drive 52 is started, the handrail drive unit 56 will roll up the handrail by a dimension 254 shown in FIG. 8, until reaching the end of the drive chain loop, and the chain tension T will be equal to W/2−F. Using 75 pounds for the force F and 100 pounds for the weight W, the tension T will be equal 100/2−75, or 25 pounds tension.

Figure 9:
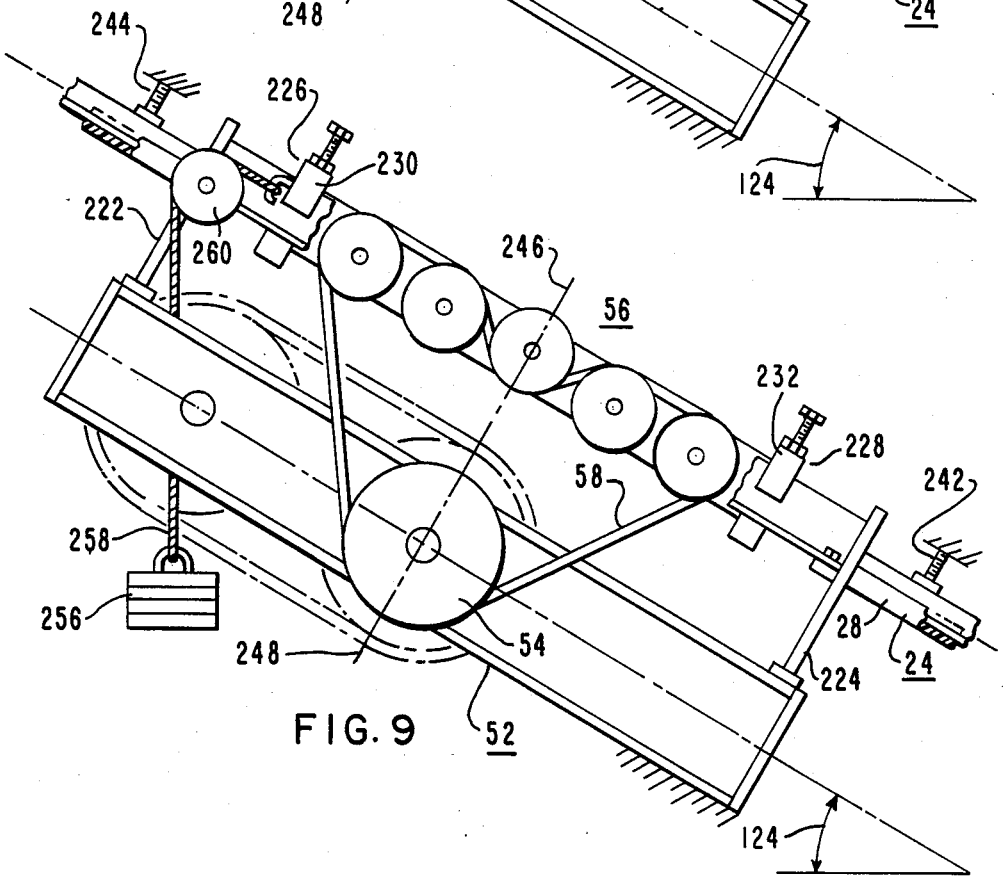
FIG. 9 illustrates how the handrail drive unit shown in FIG. 2 may be constructed to at least partially offset the force component in the drive chain or belt caused by the weight of the drive unit.

In another embodiment of the invention, the component of force W/2 is reduced, or fully cancelled, as desired. For example, as shown in FIG. 9, a counterweight 256 may be attached to the uphill end 226 of the handrail drive unit 56 via a rope 258 which is reeved over a guide pulley 260. Guide pulley 260 may be rotatably fixed to the support 222, or it may be rotatably fixed to an element of the escalator support truss 120. The weight of the counterweight 256 is selected according to the amount of compensation desired. For example, if the weight of the counterweight is selected to equal W/2, the tension in the drive chain will be equal to the force F required to drive the handrail, regardless of the direction in which the handrail is being driven.

Figure 10:
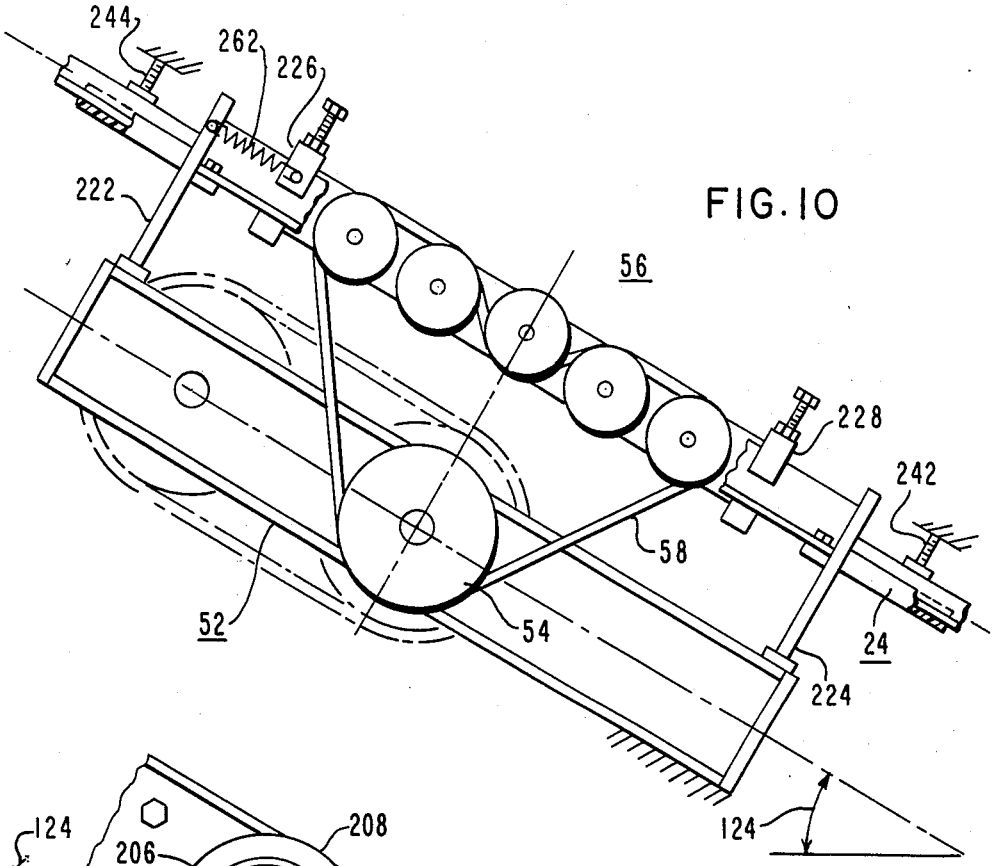
FIG. 10 is similar to FIG. 9, except setting forth another embodiment for at least partially offsetting belt or chain forces caused by the weight of the handrail drive unit.

FIG. 10 illustrates an embodiment of the invention which is similar in principle to the FIG. 9 embodiment, except compensation for the weight of the drive unit is provided by a long-stroke tension spring 262. One end of the tension spring 262 is connected to the uphill end 226 of the handrail drive unit 56, and the other end of the spring is connected to the support 222. Instead of connecting the spring 262 to the support 222, it could also be connected to an element of the escalator support truss 120. A result similar to that achieved by the tension spring can also be obtained by mounting a long-stroke compression spring (not shown) between the lower end 228 of the handrail drive unit 56 and the support 224, or an element of the escalator support truss 120.

Figure 11:
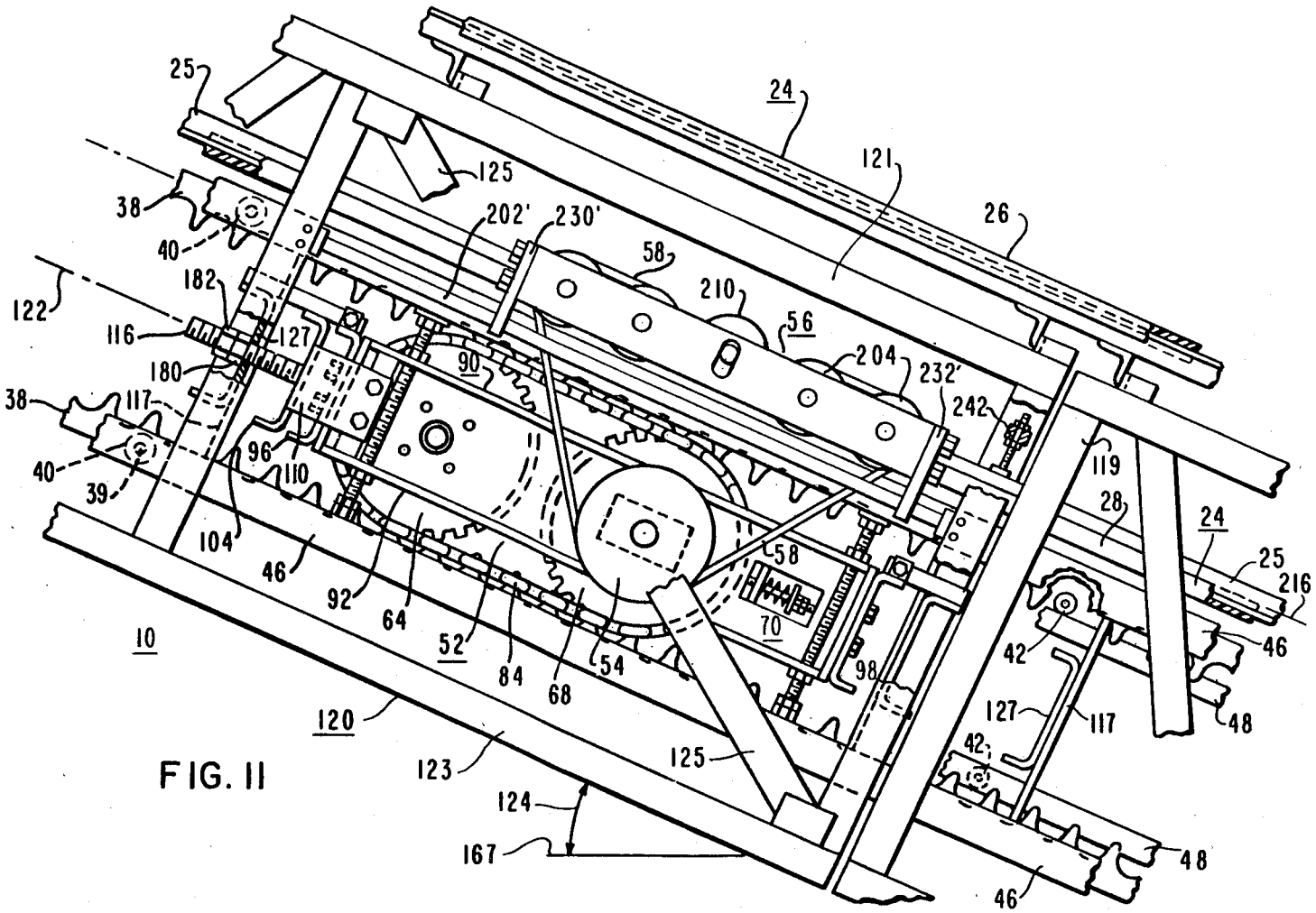
FIG. 11 is a fragmentary, elevational view of an escalator setting forth another embodiment of the invention.

FIG. 11 illustrates the invention applied to the escalator modular drive unit construction set forth in detail in co-pending application Ser. No. 532,437, filed Sept. 15, 1983, entitled "Escalator". Elements of FIG. 11 which are the same as those in FIGS. 1 and 2 are given the same reference numerals, while similar but modified components are given the same reference numerals as in FIGS. 1 and 2, with the addition of a prime mark.

As explained in detail in U.S Pat. No. 3,707,220, which is assigned to the same assignee as the present application, escalator 10 includes a support truss 120. Support truss 120 is preferably formed of a plurality of modules, with FIG. 11 setting forth an exemplary embodiment of a drive unit module. Construction of a module begins with the fabrication of right and left hand sections. For each of such half sections, upper and lower channel-shaped main tracks 46, and upper and lower angle-shaped trailer tracks 48 are precisely aligned with respect to one another through rigid connection to precision templates 117. The templates are provided at spaced intervals along the direction of travel of the transportation apparatus. The four track sections, held in rigid alignment by the templates, form track assemblies.

The half sections are completed by welding truss pieces to the track assemblies. Vertical truss members 119 are welded to alternate templates 117. Upper longitudinal truss members 121 and lower longitudinal truss members 123 are then welded to the ends of the vertical truss members 119. Added rigidity is given to the structure by diagonal truss members 125, which are welded to the upper and lower longitudinal truss members 121 and 123, respectively.

The right and left hand sections are then joined together by boxing channel members or beams 127, which are welded to predetermined templates 117.

Drive unit 52 includes a sturdy, rigid mounting frame 90. Frame 90 includes a pair of rigid side channel members, such as member 92, and front and rear rigid cross channel members 96 and 98, respectively. The adjacent ends of the side and cross channel members are secured together, such as by welding, to create a frame having a substantially rectangular configuration.

A deflection member or beam 104 is provided which is connected to the pair of side channel members via mounting plate members, such as mounting plate member 110 which interconnects the side channel member 92 and an end of the deflection member 104. A sturdy stud 116 is fixed to substantially the midpoint of the deflection beam 104, and nuts, such as nuts 180 and 182 may be engaged with stud 116 to secure the frame 90 of drive nut 52 to a cross beam 127.

In addition to fixing the drive unit 52 to the truss 120, the stud 116 and associated nuts function as a single adjustment point for moving the drive unit 52 along the incline. Adjustment of the drive unit 52 along the incline, using stud 116, automatically causes the handrail drive unit 56 to reposition itself on the slide bar 202'. In this embodiment, slide bar 202' is fixed to the vertical truss elements 119, instead of being fixed to the modular drive unit 52. First and second hanger members 230' and 232' are fixed to the longitudinal ends of the handrail drive unit 56, with the hangers 230' and 232' being slidably associated with the slide bar 202'.

As shown in FIG. 12, a continuous handrail guide arrangement may be maintained, even though the handrail drive unit 56 is slidably mounted. A handrail guide assembly 264 may be mounted on each longitudinal end of the handrail drive unit 56, which assembly is designed to cooperate with the adjacent stationary handrail guide element 25 to provide a handrail guide joint 266. For example, one of the elements, such as an element of assembly 264, may include a male portion 268, and the other element, such as the guide 25, may have a complementary opening 270 sized to snugly and slidably receive portion 268. Thus, when handrail drive 56 moves up the incline, the handrail guide joint at the upper end of the unit will close, while the joint 266 at the lower end of the handrail drive unit will open. The opposite conditions occur when the handrail drive unit 56 moves down the incline on slide bar 202'. Thus, the facing ends of the joint 266 will always be held in alignment, and firmly supported, to continue the substantially continuous handrail guide function, notwithstanding automatic movement of the handrail drive unit 56 to provide tension in the drive chain 58.

We claim as our invention:

1. An escalator comprising:

a truss, said truss having an inclined portion, a conveyor supported by said truss, said conveyor including a plurality of steps disposed in an endless loop which includes an inclined portion for transporting persons between spaced landings, at least one conveyor drive unit mounted in the inclined portion of said truss for driving the conveyor and said plurality of steps in the endless loop, an endless flexible handrail, handrail guide means supported by said truss and extending between the spaced landings for guiding the handrail in a closed loop, with the closed handrail loop including upper and return runs each having an inclined portion, handrail drive means disposed immediately above said at least one conveyor drive unit and positioned to engage the handrail on the inclined portion of the return run, to provide a driving force for driving the handrail about the closed loop, with the handrail drive means including a plurality of spaced pairs of rollers, with each pair including a traction roller in contact with a first surface of the handrail, a pressure roller in contact with a second surface disposed opposite the first surface, and means providing a biasing force, unrelated to the handrail driving force, for biasing the pressure roller against the second surface, belt means disposed to link both said at least one conveyor drive unit and said handrail drive means, to cause rotation of the traction rollers, tension means for automatically providing the desired tension in the belt means, notwithstanding wear thereof or adjustment of said at least one conveyor drive unit along the inclined portion of said truss, said tension means including means mounting the handrail drive means for guided, longitudinal movement along the incline of the return run, such that the handrail drive means is free to move along the handrail with positional adjustment of said at least one conveyor drive unit along the inclined portion of said truss, and such that when the position of said at least one conveyor drive unit is fixed, movement of said handrail drive means along the handrail is restrained only by the belt means, with the effective weight of the handrail drive means on the handrail being selected such that a summation of the forces in the belt means due to the effective weight of the handrail drive means and the force required to drive the handrail about its closed loop produces a net desired tensioning force in the belt means.

2. The escalator of claim 1 wherein the weight of the handrail drive means is selected such that its effective weight along the incline provides a force component in the belt means which exceeds the force required to drive the handrail, providing a net tensioning force in the belt means due to the tendency of the handrail drive means to move along the handrail down the incline, regardless of handrail driving direction.

3. The escalator of claim 1 wherein the weight of the handrail drive means is selected such that its effective weight along the incline provides a force component in the belt means which is less than the force required to drive the handrail, providing a net tensioning force in the belt means due to the tendency of the handrail drive means to move along the handrail down the incline when the handrail is being driven up the incline of the return run, and due to the tendency of the handrail drive means to move along the handrail up the incline when the handrail is being driven down the incline of the return run.

4. The escalator of claim 1 wherein the effective weight of the handrail drive means on the handrail is substantially zero, such that only the force required to drive the handrail tensions the belt means, regardless of the handrail driving direction and regardless of the absolute weight of the handrail drive means.

5. The escalator of claim 1 wherein the means for mounting the handrail drive means includes an elongated slide bar member fixed to the escalator drive means, and means mounting the handrail drive means for slidable movement on the slide bar member.

6. The escalator of claim 1 wherein the means for mounting the handrail drive means includes an elongated slide bar member fixed to the truss, and means mounting the handrail drive means for slidable movement on the slide bar member.

7. The escalator of claim 1 including at least one additional conveyor drive unit mounted in the inclined portion of the truss, spaced from the at least one conveyor drive unit, and an additional handrail drive means disposed immediately above said at least one additional conveyor drive unit, said additional handrail drive means being positioned to engage the handrail and provide a driving force therein, and tension means for mounting said additional handrail drive means for guided longitudinal movement, similar to the mounting of the handrail drive means disposed above the at least one conveyor drive unit.

* * * * *